US007462085B2

(12) United States Patent
Moyal

(10) Patent No.: US 7,462,085 B2
(45) Date of Patent: Dec. 9, 2008

(54) SWIM FIN WITH ADJUSTABLE WEB

(76) Inventor: Ronen M. Moyal, 2409 N. Evergreen, Arlington Heights, IL (US) 60004

( * ) Notice: Subject to any disclaimer, the term of this patent is extended or adjusted under 35 U.S.C. 154(b) by 0 days.

(21) Appl. No.: 11/594,671

(22) Filed: Nov. 7, 2006

(65) Prior Publication Data

US 2007/0167095 A1 Jul. 19, 2007

Related U.S. Application Data

(63) Continuation-in-part of application No. 11/334,577, filed on Jan. 18, 2006.

(51) Int. Cl.
*A63B 31/08* (2006.01)

(52) U.S. Cl. ..... 441/64

(58) Field of Classification Search ..... 441/60–64; D21/806

See application file for complete search history.

(56) References Cited

U.S. PATENT DOCUMENTS

| | | | |
|---|---|---|---|
| 4,752,259 | A | 6/1988 | Tackett et al. |
| 4,981,454 | A | 1/1991 | Klein |
| 5,292,272 | A | 3/1994 | Grim |
| 5,447,457 | A | 9/1995 | Kamitani |
| 5,632,662 | A | 5/1997 | Cadorette |
| 6,129,601 | A | 10/2000 | Aucoin |
| 6,247,982 | B1 | 6/2001 | Walker |
| 6,346,021 | B1 | 2/2002 | Masse |
| 6,568,975 | B1 | 5/2003 | Perry et al. |
| 6,672,920 | B2 | 1/2004 | Wilson |
| 6,814,640 | B1 | 11/2004 | Houck |
| 6,893,307 | B1 | 5/2005 | Melius |

*Primary Examiner*—Ed Swinehart

(57) ABSTRACT

A swim fin having a web portion pivotably attached to a shoe portion that is rotatable to a first position substantially perpendicular to the shoe portion for walking and a second position in a plane with the shoe portion for propulsion in water.

10 Claims, 7 Drawing Sheets

SWIM FIN WITH ADJUSTABLE WEB

CROSS-REFERENCE TO RELATED APPLICATIONS

This is a continuation-in-part of U.S. patent application Ser. No. 11/334,577, filed Jan. 18, 2006, which is incorporated by reference.

FIELD OF THE INVENTION

This invention relates to swim fins that have an adjustable web portion movable into a first and second position. More particularly, the invention relates to swim fins wherein the fins are adjusted so the user can walk with the fins in the first position and swim in water with the fins in the second position.

BACKGROUND OF THE INVENTION

Traditionally, swim fins are adapted to provide propulsion of the user in water. When wearing swim fins the user typically has difficulty walking on hard surfaces, land, the beach or a boat because of the size, shape and flexibility of the swim fin.

The prior art addresses issues relating to propulsion in water as seen, for example, in U.S. Pat. No. 6,129,601. The patent describes a swim fin with a web portion pivoted upon a foot receiving portion. The web moves from a walking position to a swimming position by rotating the web under the foot of the user so that it may be placed on the back of the leg of the user. The web requires a positive pivot stop to prevent the web from rotating upward beyond the swimming position. The foot receiving portion has a tapered nose protrusion that cooperates with a latch mechanism on the web. U.S. Pat. No. 4,752,259 describes a swim fin having a swimming or walking mode wherein the fin has two parts hingedly engaged by a joint assembly for movement from a locked walking position to a locked swimming position. The web pivots below the foot from the swimming position to the back of the leg for the walking position.

It is desired to have a swim fin that has a foot portion and a pivotally mounted web portion for movement into a first position for walking and a second position for propulsion in water.

SUMMARY OF THE INVENTION

The swim fin of the present invention advantageously provides a swim fin comprising a foot portion and a web portion. The web portion is pivotally attached to the foot portion. When the web portion is placed in a first position, for walking, the web portion is substantially perpendicular to the foot portion and provides for facile movement on land and hard surfaces. With the web portion in the second position and extending outwardly from the foot portion, the swim fin is capable of propelling the user in water. A resilient member in a relaxed state allows the web to be placed in the first position. The web is rotated by compressing the resilient member into a second position for swimming. The rotation is about 90 degrees from the first position to the second position which is in the same plane as the foot. The web portion engages a locking mechanism or lip which holds the web portion in place for swimming.

These and other objects, features and advantages will be better understood from the following description of the preferred embodiments of this invention, when taken in conjunction with the following drawings.

DETAILED DESCRIPTION OF A PREFERRED EMBODIMENT

Figure 1:
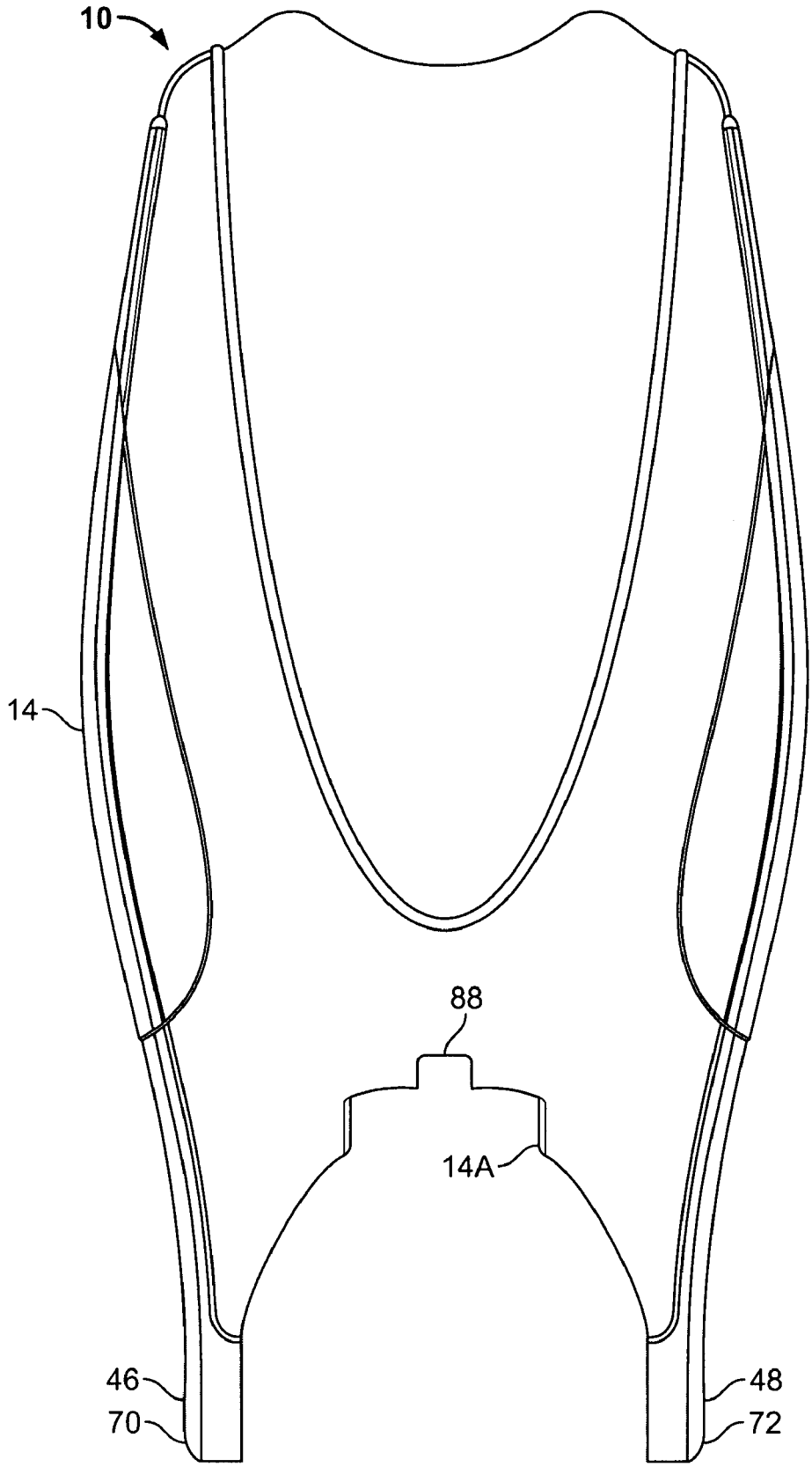
FIG. 1 is a top view of one embodiment of a swim fin of the present invention.
Figure 2:
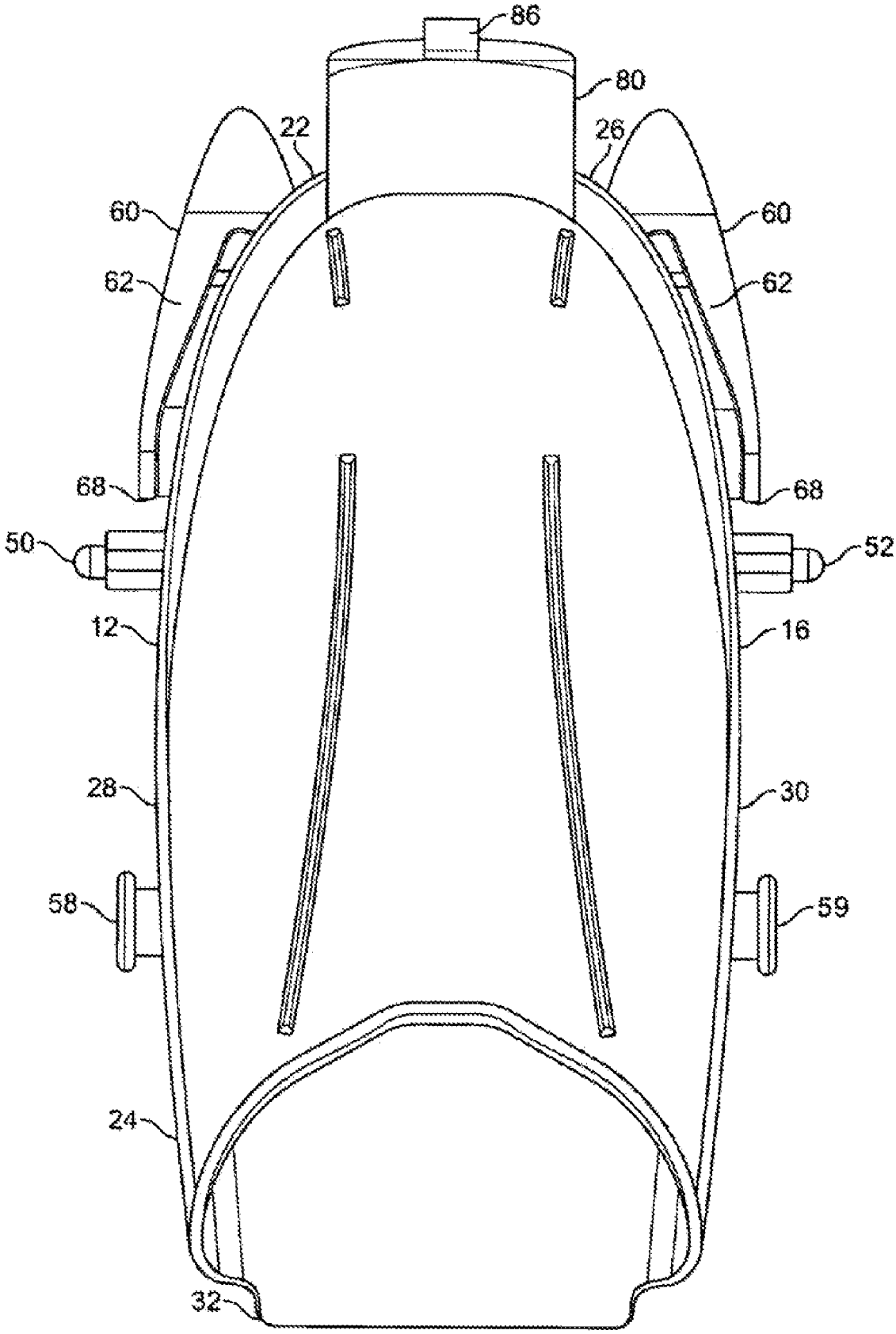
FIG. 2 is a top view of an embodiment of the present invention illustrating a foot portion.

The present invention will now be described more fully hereinafter with reference to the accompanying drawings, in which various embodiments of the invention are shown. Unless otherwise defined, terms used herein have the same meaning as commonly understood by one with ordinary skill in the art to which the invention pertains. Although methods and materials similar or equivalent to those described herein can be used in the practice or testing of the present invention, suitable methods are described below. In addition, materials and methods given are illustrative in nature only and not intended to be limiting. Accordingly, this invention may be embodied in different forms and should not be construed as limited to the illustrated embodiments set forth herein. The illustrated embodiments are provided solely for exemplary purposes so that this disclosure will be thorough and complete. Other features and advantages of the invention will apparent from the following detailed description, and from the claims.

FIGS. 1-9 illustrate embodiments of a swim fin 10 comprising a foot portion 12 and a web portion 14. The foot portion 12 has shoe 16 for receiving the foot of the user. The term "shoe" is used herein with reference to the foot portion 12 is intended to include any structural arrangement which permits the user to secure the swim fin to the foot. For example, a "shoe" in the foot portion may be a compartment of sufficient size to therein receive the forward portion of a user's foot, and having connected thereto securing means 20 around the heel of the user's foot. This and other arrangements as understood by skilled workers in the art for securing the swim fin in contact with the foot are intended to be included within the meaning of the term "shoe" as employed herein and recited in the claims. The foot portion has a first end 22, a second end 24, a toe 26, a first 28 and second 30 sidewalls and bottom 32.

The heel of the user's foot is held in place by securing means 20. Securing means 20 can be any arrangement or device for securing the user's foot in shoe 16. It may comprise material that encloses the heel and foot or wraps around the back of the user's heel. Preferably, the securing means is an adjustable strap 34. However, the use of the adjustable strap is not intended to be unduly limitative. Posts 58 and 59 hold strap 34 in contact with the user's foot.

Figure 3:
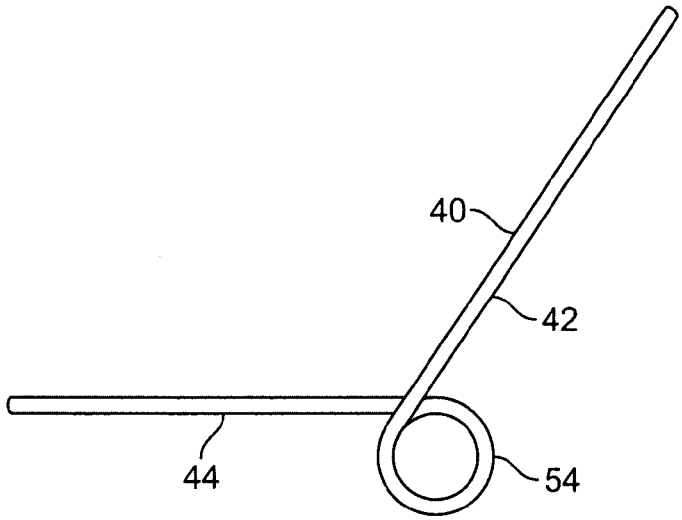
FIG. 3 is a side elevational view of the resilient member of an embodiment of the invention.
Figure 4:
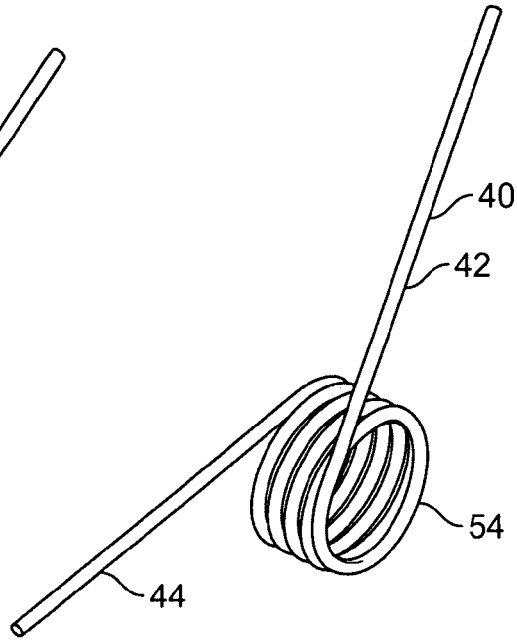
FIG. 4 is a perspective view of the resilient member of an embodiment of this invention.
Figure 5:
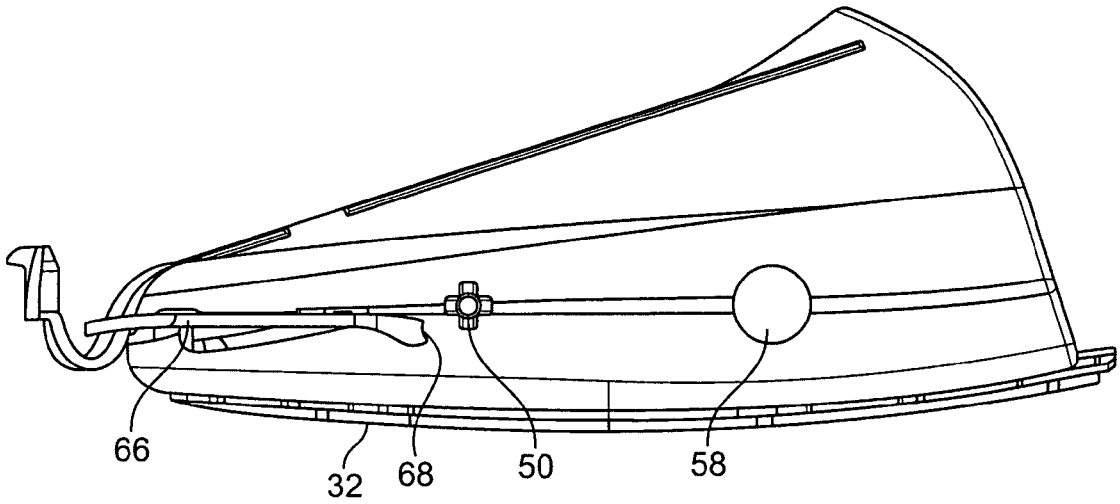
FIG. 5 is a side elevational view of the foot portion of the present invention a locking mechanism and stop platform for securing the web portion in a second or swimming position by the user.
Figure 9:
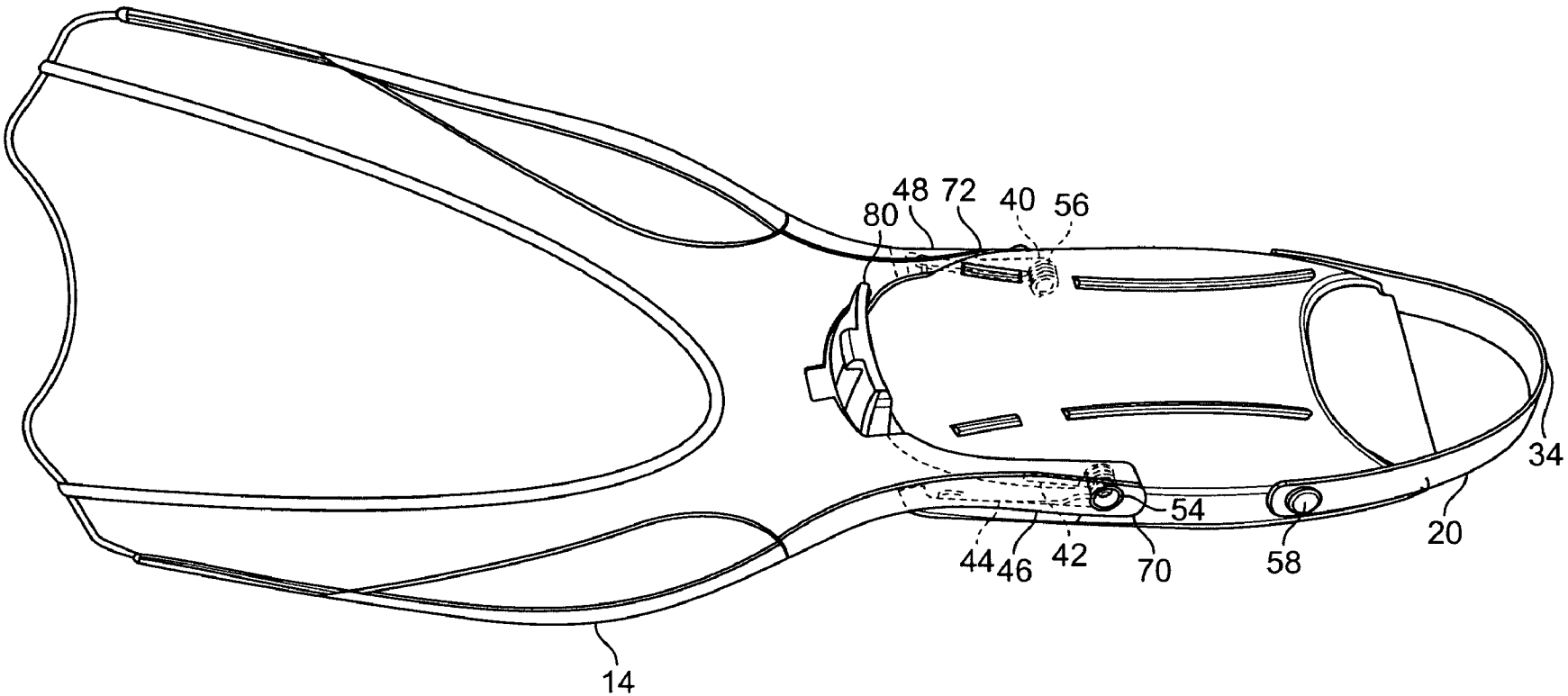
FIG. 9 is a perspective view of an embodiment of the present invention showing the web portion is locked in the plane of the foot portion in a second position thereby allowing swimming motion by the user.

The web portion 14 of swim fin 10 includes a resilient member 40 embedded in the web portion 14 as shown in dotted lines in FIG. 9. More specifically, resilient member 40 has upper resilient member 42 which passes through first and second opposed extensions or arms 46 and 48 of web portion 14. Indeed, the resilient member 40 is preferably constructed of one piece of resilient material as shown in FIGS. 3 and 4. The resilient member 40 includes lower resilient member 44 which secures the web to the shoe 16 and to upper resilient member 42. The resilient member 40 and its upper and lower resilient members are made from a flexible spring-like material such as metal, for example, flexible steel, or plastic. The material must be flexible for the upper resilient member must pivot about ninety degrees to be operational. The lower and upper resilient members meet at joints or posts 50 and 52 with pivot members or coils 54 and 56 allowing the resilient members 44 (lower) and 42 (upper) to pivot. The resilient member is preferably one continuous piece of the spring-like material. When the spring-like material is relaxed, the web 14 is in the first position for walking by the user. When the spring-like material is in a folded or compressed state, the web 14 is locked to the shoe 16 in a second position for swimming by the user. It may preferably be wrapped around joints or bolts 50 and 52, included in pivot members 54 and 56.

FIGS. 2, 5-8 and 9 illustrate stop 60 attached to the sidewalls of shoe 16. Stop 60 has an upper surface 62 for engaging web portion 14, lower surface 64 and brake 66 with curved end 68. Stop 60 extends on the sidewalls of the shoe for a sufficient distance to serve as a support for web portion 14. It follows the contour of the sidewalls as they curve to form toe 26.

In a relaxed position, resilient member 40 positions web portion 14 in the first position extending generally perpendicular to shoe 16. The web portion may preferably be attached to a retainer on the user's leg. The lower portion 70 and 72 of first and second extensions or arms 46 and 48 of the web include channel 74 for securing upper resilient member 42. The tension of the resilient member holds it in the channel. Stop 60 includes channel 76 in its upper surface 62 for securing lower resilient member 44. The upper and lower resilient members are joined by pivot members or coils 54 and 56. When web portion 14 is placed in the first position which allows walking by the user, brakes 66 and its curved ends 68 engages lower portions 70 and 72 of web extensions or arms 46 and 48 to stabilize them.

Figure 6:
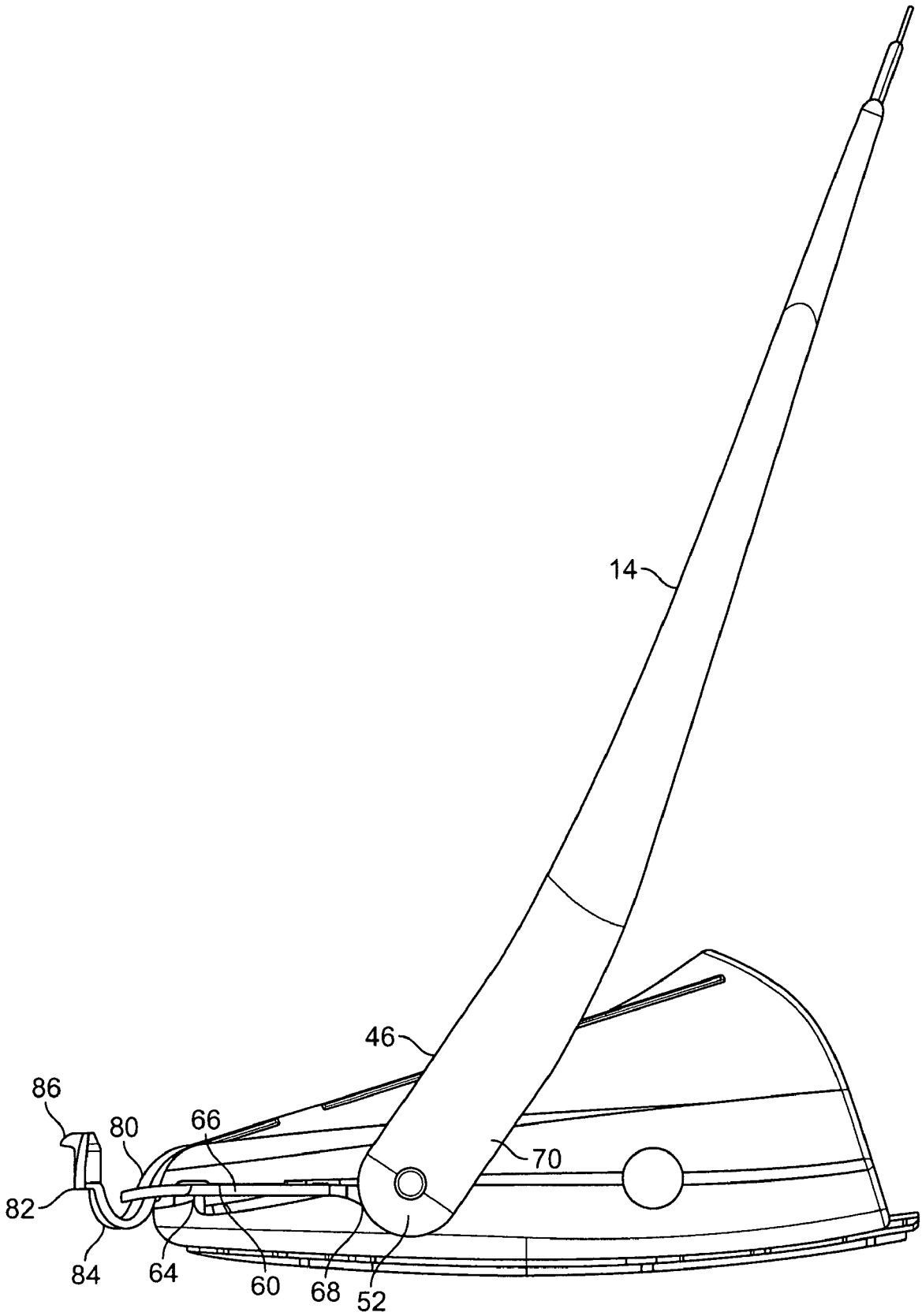
FIG. 6 is a side elevational view of an embodiment of the present invention wherein the web portion is pivotally attached to the foot portion in a first position perpendicular to the foot portion thereof allowing walking by the user while wearing the swim fin.
Figure 7:
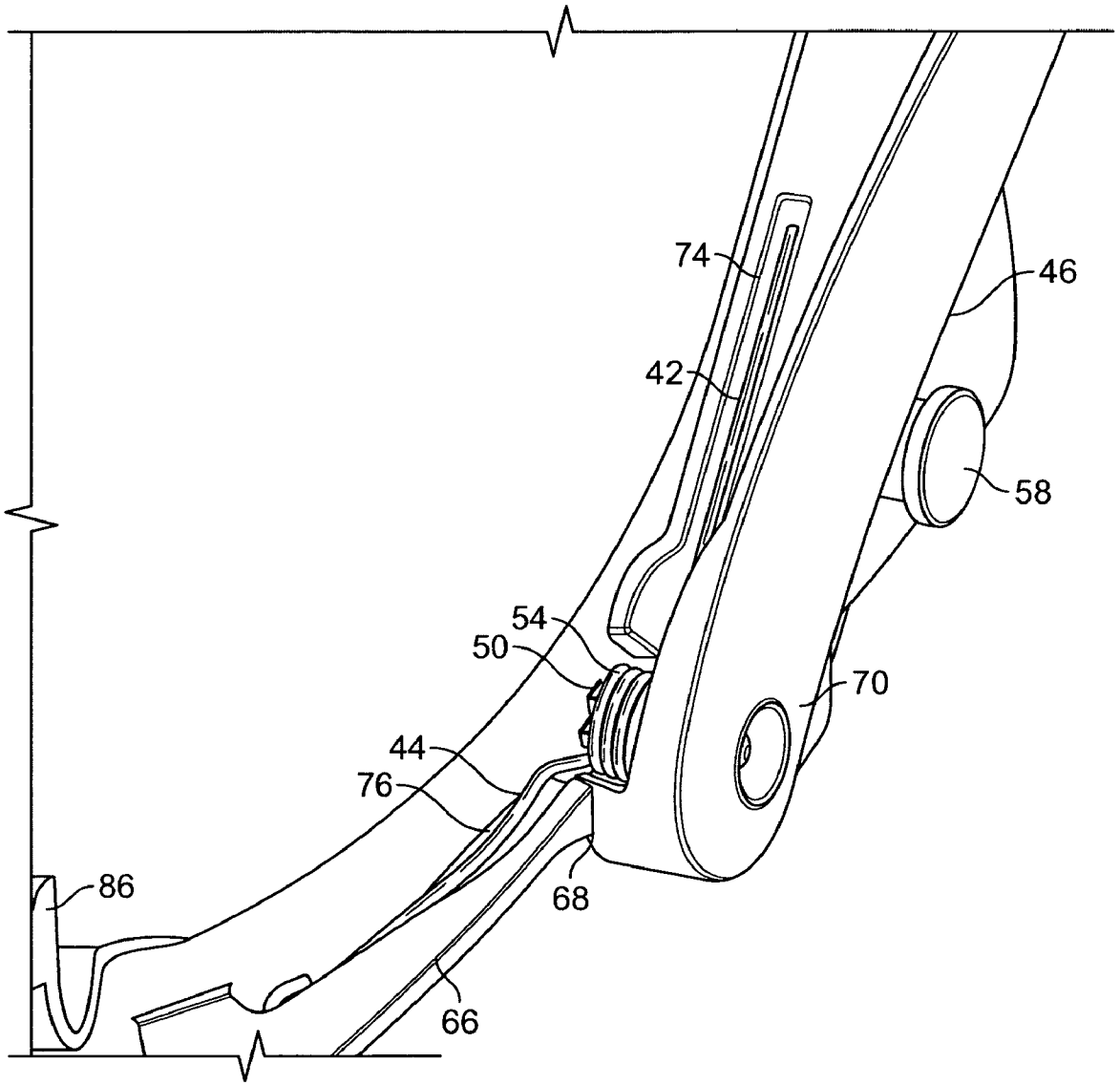
FIG. 7 is a perspective view of an embodiment of the present invention wherein the foot portion and web portion are engaged in a first position for allowing walking by the user showing the removable resilient member embedded in an arm of the web portion and stop platform.
Figure 8:
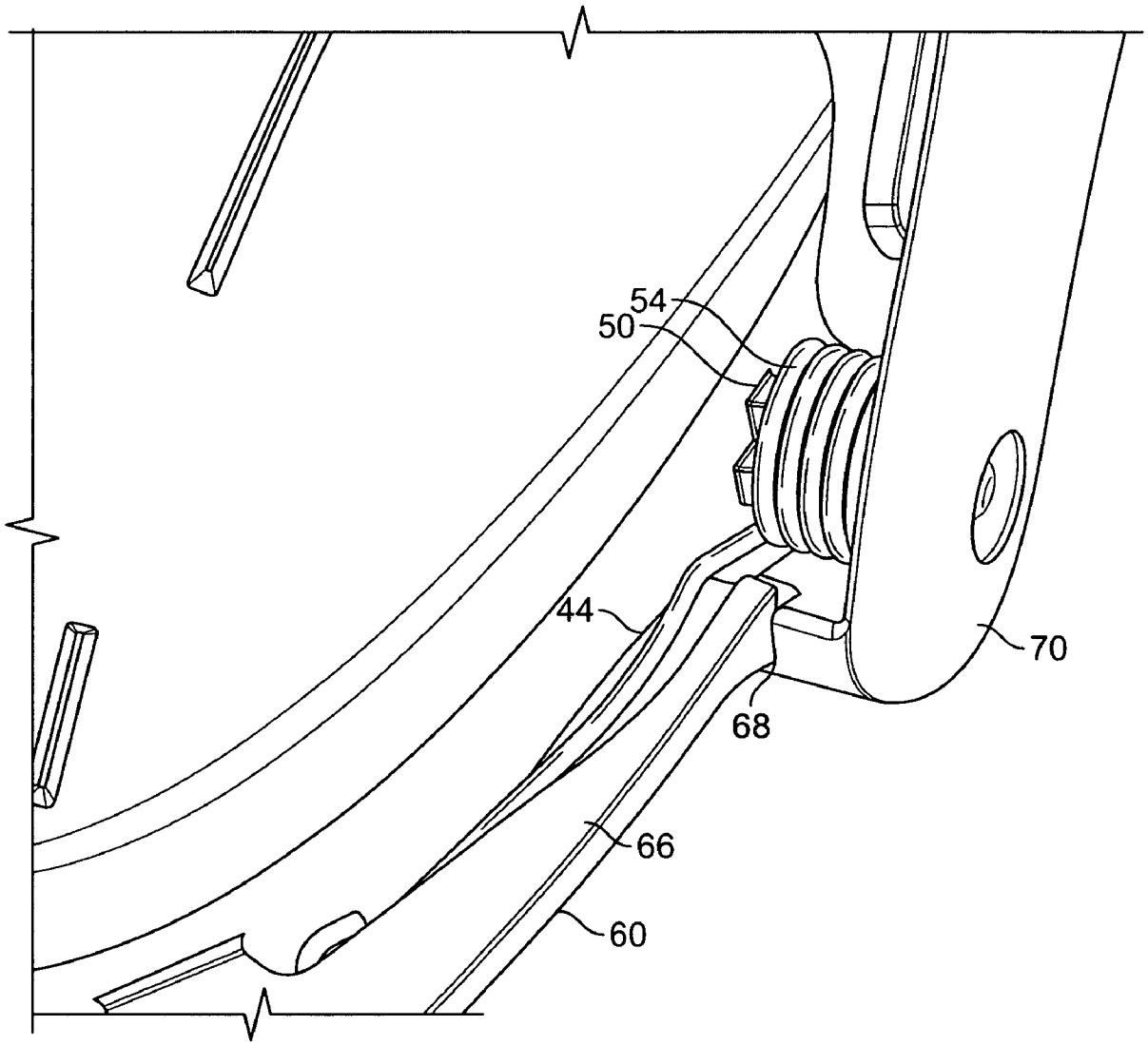
FIG. 8 is a perspective view of an embodiment of the present invention showing the resilient member embedded in the arm and stop platform and brake engaging the arm to secure the web portion in a first position to enable the user to walk while wearing the fins.

With reference to FIG. 6, force must be used to rotate web portion 14 cooperating with pivot members 54 and 56 to compress resilient member 40 to move it into the second position for swimming. A locking mechanism 80, when engaged, retains the upper resilient member 42 from rotating into the first position. Further, stop 60 assists in the stabilization of web portion 14 by its engagement of it on its upper surface 62.

Resilient member 40 can be readily removed from channels 74 and 76 by hand and replaced, if necessary. The accessibility of the resilient member ensures consistent use without fear of breakage or wear on the resilient member.

Locking mechanism 80 is made from any suitable flexible material, for example, flexible plastic or rubber material. It is attached to shoe 16 at toe 26, extending forwardly from the shoe. The plastic or rubber material must be sufficiently flexible for allowing the insider periphery 14A of web portion 14 to snap fit under lip or shoulder 82 which is an extension of curved neck 84 of the locking mechanism. The rounded, concave locking mechanism cooperates with the rounded toe 26 of shoe 16 and inside periphery 14A of the web portion 14.

To aid in the release of the web portion 14 from locking mechanism 80, a flange or tab 86 is positioned on the top of lip 82. Tab 86 can be pressed toward the shoe to release web portion 14 from locking mechanism. This can be accomplished by the user's hand or foot for a quick release. Slot 88 is positioned on the inside periphery 14A of the web to accommodate tab 86 when the web portion is rotated.

The web portion 14 is rotated above the shoe from a first position for walking generally perpendicular to the shoe for about ninety degrees to a second position, generally in the same plane as the shoe, for swimming. The web is secured by locking mechanism 80 and supported by stop 60. The rotation of the web is above the shoe, for the web cannot rotate below the shoe because of the structure of resilient member 40. Pivot member 54 and resilient member 40 cannot be rotated in a direction where the web would pass under the shoe.

In operation, the user's foot is placed in shoe 16, and the conventional securing means 20 or strap 34 are utilized for holding the foot in the shoe. For walking on hard surfaces, the web 14 is placed into the first position wherein the web portion is substantially perpendicular to the shoe. The web is merely rotated to this position or it may rotate into the first position by the action of the resilient member, preferably a one piece flexible spring having an upper resilient member placed in a channel in web 14 and a lower resilient member placed in a channel in a stop. The resilient member is secured around joints or pivot members to pivot web 14 from a first position for walking and a second position for swimming. For placement into the second position, web 14 is rotated to toe a locking mechanism on the toe of the shoe where it is secured. The fin is then in the second position for propelling the user in water.

Typical embodiments have been described in the drawings and specification. Specific terms have been used; however, the terms are used in a descriptive sense only and are not intended to be limitative. The invention has been described in considerable detail with specific reference to the illustrated embodiments. It will be apparent, however, that various modifications and changes can be made within the spirit and scope of the invention as described in the foregoing specification and as defined in the appended claims.

What is claimed is:

1. A swim fin comprising:

a foot portion having a first end, a second end, a toe, and first and second sidewalls, a web portion, with first and second opposed extensions, pivotally attached to the foot portion, pivot members for rotating the web portion to a first and second position, stops for supporting the web portion mounted on sidewalls on the foot portion, said stops having open channels, resilient members having an upper member extending into an open channel on each web extension for pivoting the web portion to rotate from a first position to a second position and a lower member extending into an open channel on said stops, a locking mechanism for engaging the web portion in the second position, said locking mechanism containing a lip extending outwardly from the toe of the foot portion for engaging the web portion, a flange for facilitating the release of the lip from an inside periphery of the web portion, wherein the lip matches the contour of the inside periphery of the web portion and the contour of the shoe.

2. The swim fin of claim 1, wherein the pivot members have joints on first and second sidewalls of the foot portion.

3. The swim fin of claim 1, wherein the lip has a shoulder for engaging an inside periphery of the web portion for securely holding it in a second position for swimming by the user.

4. The swim fin of claim 1 wherein the resilient member can be readily removed from the first and second extensions and stops.

5. The swim fin of claim 1, wherein the upper member of the resilient member is biased in the first position.

6. The swim fin of claim 2, wherein the resilient member is coiled around the joints.

7. The swim fin of claim 1, wherein the stops include a brake for engaging first and second extensions of the web portion in the first position.

8. The swim fin of claim 7, wherein the brake has a curved end for engaging first and second extensions of the web.

9. The swim fin of claim 6, wherein the upper member of the resilient member rotates about 90° from the first position to the second position.

10. The swim fin of claim 1, wherein the upper and lower members of the resilient member are linear for engaging the open channel on the first and second extensions of the web portion and the open channels on said stops.

* * * * *